US007410085B2

(12) United States Patent
Wolf et al.

(10) Patent No.: US 7,410,085 B2
(45) Date of Patent: Aug. 12, 2008

(54) ELECTRICAL DRIVE-IN TOOL

(75) Inventors: Iwan Wolf, Untervaz (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 67 days.

(21) Appl. No.: 11/416,859

(22) Filed: May 2, 2006

(65) Prior Publication Data

US 2006/0261127 A1 Nov. 23, 2006

(30) Foreign Application Priority Data

May 18, 2005 (DE) ..... 10 2005 000 062

(51) Int. Cl.
*B65C 1/06* (2006.01)

(52) U.S. Cl. ..... 227/131; 227/2; 227/132; 173/117

(58) Field of Classification Search ..... 227/131, 227/2, 132, 130; 173/13, 117, 124
See application file for complete search history.

(56) References Cited

U.S. PATENT DOCUMENTS 3,924,789 A * 12/1975 Avery et al. ..... 227/131
4,042,036 A * 8/1977 Smith et al. ..... 173/13
4,323,127 A * 4/1982 Cunningham ..... 173/53
4,928,868 A * 5/1990 Kerrigan ..... 227/131
4,946,087 A * 8/1990 Wingert ..... 227/131
5,098,004 A * 3/1992 Kerrigan ..... 227/134
6,364,193 B1 * 4/2002 Tsai ..... 227/131
6,662,990 B1 * 12/2003 Sun ..... 227/131
6,766,935 B2 * 7/2004 Pedicini et al. ..... 227/131
6,796,477 B2 * 9/2004 Chen ..... 227/2
6,854,530 B1 * 2/2005 Yiu ..... 173/1
6,857,549 B1 * 2/2005 Chen ..... 227/131
7,165,305 B2 * 1/2007 Kenney et al. ..... 29/434

* cited by examiner

*Primary Examiner*—Scott A. Smith
(74) *Attorney, Agent, or Firm*—Abelman, Frayne & Schwab

(57) ABSTRACT

A drive-in tool for driving in fastening elements includes a driving ram (13) displaceable in a guide (12) and driven by a drive flywheel (32), a drive unit (30) having an electric motor (31) for rotating the drive flywheel (32), a drive coupling (35) for connecting a coupling section (15) of the driving ram (13) with the at least one drive flywheel (32), and an acceleration device (40) for accelerating the driving ram (13), together with the coupling section (15) in a direction of the drive flywheel (32).

11 Claims, 10 Drawing Sheets

ELECTRICAL DRIVE-IN TOOL

BACKGROUND OF THE INVENTION

1. Field of the Invention

The present invention relates to an electrical drive-in tool for driving in fastening elements and including a driving ram displaceable in a guide for driving in a fastening element, at least one drive flywheel for driving the driving ram, and a drive unit for driving the at least one drive flywheel and including an electric motor for rotating the at least one drive flywheel, and a drive coupling for connecting a coupling section of the driving ram with the at least one drive flywheel.

2. Description of the Prior Art

In electrical drive-in tools of the type described above, the driving ram is accelerated by the flywheel that is driven by a motor. In drive-in tools, the drive-in energy, which is supplied by an accumulator, amounts maximum to about 35-40 J. In drive-in tools, which were developed on the basis of a flywheel principle, the energy which is stored in the flywheel, must be transferred to the driving shaft by a coupling. The coupling should be capable of being very rapidly actuated and should be capable of transmitting a very high power in a short period of time. The coupling also should be capable of being rapidly deactuated at the end of the drive-in process.

A drive-in tool of the type described above is disclosed in U.S. Pat. No. 4,928,868. In the drive-in tool of U.S. Pat. No. 4,928,868, the driving ram is displaced between a motor-driven flywheel and an idler wheel. In order to frictionally couple the driving ram with the flywheel, the driving ram is displaced toward the flywheel by an adjusting mechanism, is pressed against the circumferential surface of the flywheel, and is accelerated.

A drawback of the known drive-in tool consists in that upon coupling of the driving ram with the drive flywheel slippage occurs when the quasi-stationary driving ram contacts the rotating flywheel. The slippage leads, on one hand, to energy losses and, on the other hand, to wear of the contact surfaces. The slippage also causes a time delay in the acceleration of the driving ram during braking of the flywheel. Therefore, obtaining of high rotational speeds of the flywheel and, thereby, of a drive-in energy of more than 35 J is not possible. This is because the resulting increased heating caused by friction leads to damage of the driving ram and of the surface of the flywheel, which further increases wear of these parts.

Accordingly, an object of the present invention is a drive-in tool of the type discussed above in which a high drive-in energy can be obtained in a technically simple way, and the above-mentioned drawbacks of the known drive-in tool are eliminated.

SUMMARY OF THE INVENTION

This and other objects of the present invention, which will become apparent hereinafter, are achieved, according to the invention by providing an acceleration device for accelerating the driving ram, together with the coupling section, in the direction of the flywheel.

The acceleration of the driving ram takes place before the driving ram is coupled to the drive flywheel. This permits to noticeably reduce slippage when the driving ram is coupled with the flywheel, which, in turn, reduces the energy losses and wear. Further, the drive flywheel can be driven with a high rotational speed. The high rotational speed of the flywheel permits to increase the achievable maximum possible drive-in energy of the driving ram, and achieving a drive-in energy up to 80 J becomes possible.

It is advantageous when the acceleration device transmits to the driving ram a kinetic energy from about 50 mJ to about 20 J. With such a kinetic energy, the driving ram can be accelerated to a speed from 0.5 m/s to about 20 m/s even before the driving ram is coupled with the drive flywheel.

The acceleration device transmits to the driving ram a pulse from about 50 g*m/s to 3 Kg*m/s.

In a technically simple embodiment of the inventive drive-in tool, the acceleration device has a force accumulator which is preloaded against the driving ram in an initial position of the driving ram and which elastically accelerates the driving ram in the direction of the drive flywheel. Advantageously, the drive-in tool includes locking means for retaining the driving ram in the initial position. Advantageously, the force accumulator is formed as a compression spring element.

In an advantageous durable embodiment, the locking means includes a pawl that engages, in its locking position, a locking surface of the driving ram.

Advantageously, the locking means is released by an actuation switch and is displaced, upon being released, to its release position in which the pawl releases the driving ram. This insures a more rapid repetition of the drive-in sequences with the drive-in tool according to the present invention.

According to a further advantageous embodiment of the present invention, the acceleration device includes motorized acceleration means, which permits to obtain, in a simple manner, a high energy for a preliminary acceleration of the driving ram.

It is advantageous when the motorized acceleration means includes an electric motor that is connected with the driving ram by a driven element. When the electric motor is not the same motor that forms part of the drive unit, it can have smaller dimensions than the motor of the drive unit.

An easily controlled acceleration device includes a magnetic coil with which the driving ram, which is formed as an iron core, is accelerated. The advantage of this acceleration device consists also in that an additional locking device for retaining the driving ram in its initial position is not necessary. This is because the driving ram can be retained in its initial position by the magnetic coil.

According to another advantageous embodiment of the present invention, the acceleration device includes an acceleration flywheel, a maximal circumferential speed of which is smaller than a maximal circumferential speed of the drive flywheel.

During a drive-in process, the acceleration flywheel becomes coupled with the driving ram before the driving ram is coupled with the drive flywheel. This acceleration device is easily mountable in the drive-in tool and provides for a good acceleration of the driving ram. In addition, because of staged rotational speeds of the acceleration flywheel and the drive flywheel, the slippage on both the drive flywheel and the acceleration flywheel is small.

Advantageously, the drive flywheel and the acceleration flywheel are supported on separate axles. With the drive flywheel and the acceleration flywheel arranged one after another, the coupling section of the driving ram is first coupled, during a drive-in process, with the acceleration flywheel for a short time, and is then coupled with the drive flywheel.

In accordance with a still further advantageous embodiment of the present invention, the drive flywheel and the acceleration flywheel are supported on one and the same axle, which provides for a compact design. In this case, the driving ram is provided with a second coupling section specifically for coupling the driving ram with the acceleration flywheel.

Advantageously, the drive flywheel and the acceleration flywheel can be formed as a one-part member.

Preferably, the acceleration flywheel has a smaller outer diameter than an outer diameter of the drive flywheel. With such diameters of the drive and acceleration flywheels, the circumferential speed of the acceleration flywheel can be kept smaller than the circumferential speed of the drive flywheel in a very simple manner.

It is advantageous when the drive unit drives both the drive flywheel and the acceleration flywheel. This provides for a compact design and permits to keep the manufacturing costs low.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 7 a longitudinal cross-sectional view of the drive-in tool shown in FIG. 6 in a first operational position thereof;

DETAILED DESCRIPTION OF THE PREFERRED EMBODIMENTS

Figure 1:
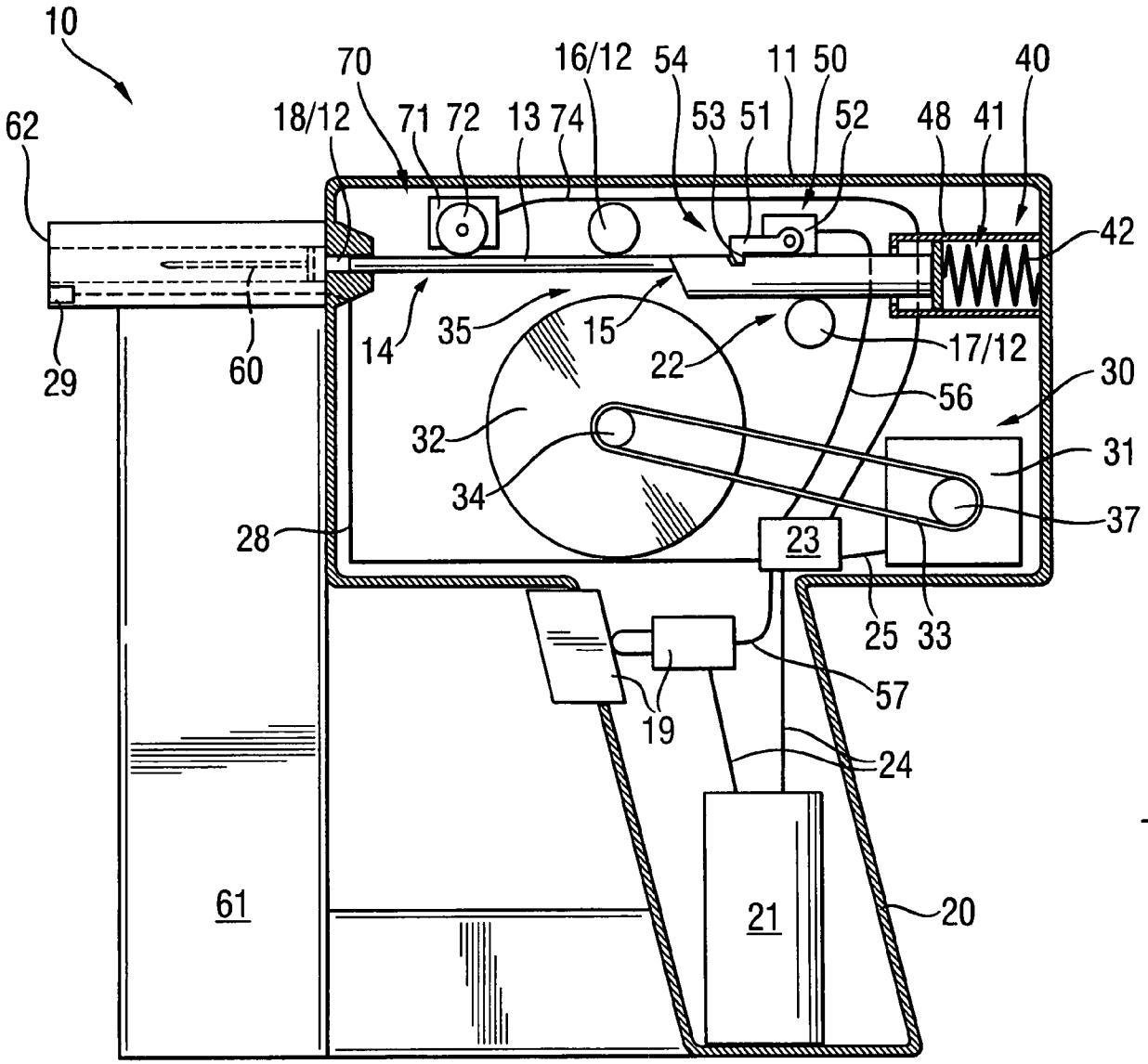
FIG. 1 a longitudinal cross-sectional view of a drive-in tool according to the present invention in an initial position thereof.
Figure 2:
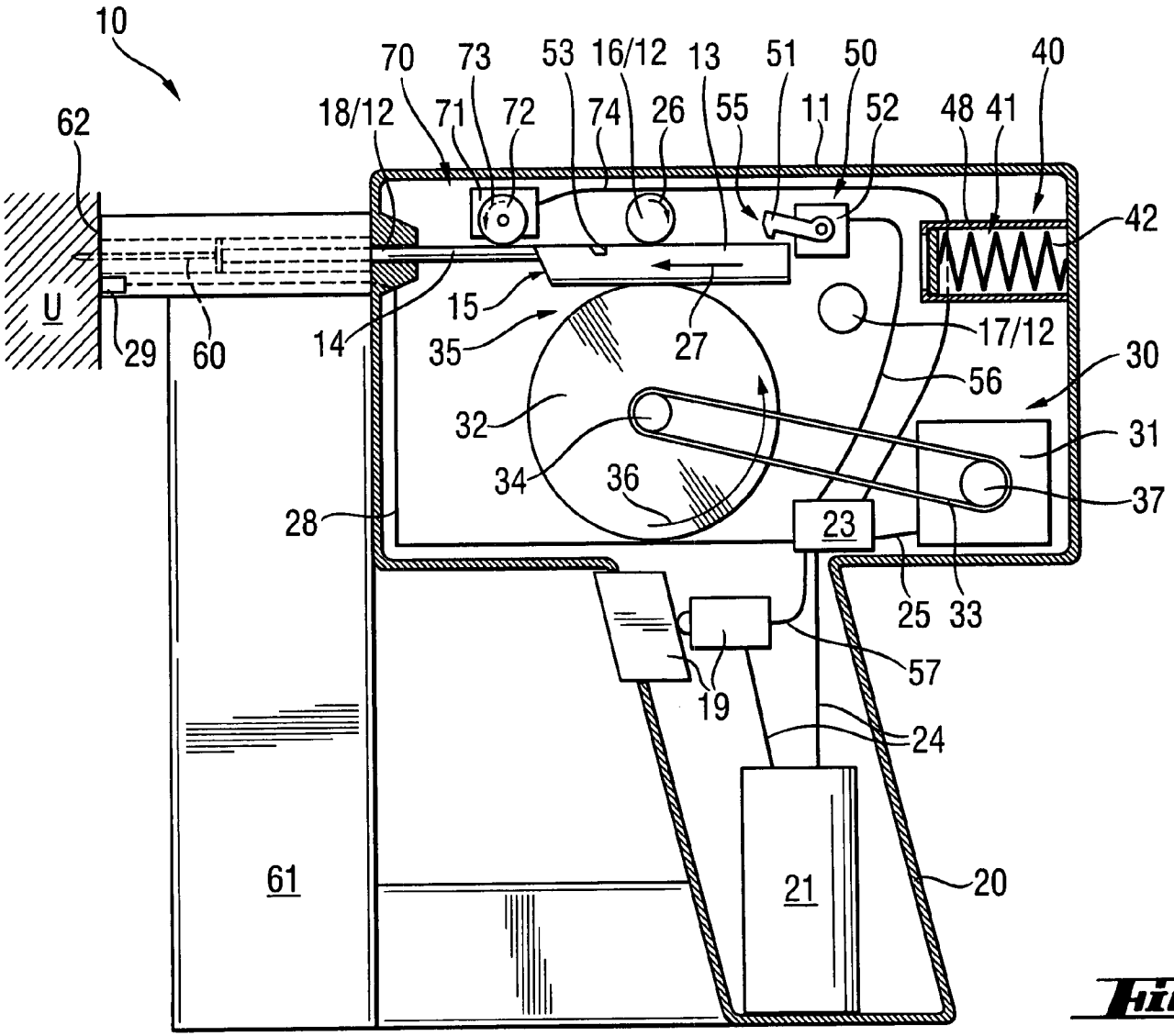
FIG. 2 a longitudinal cross-sectional view of the drive-in tool shown in FIG. 1 in an operational position thereof.

A drive-in tool 10 according to the present invention, which is shown in FIGS. 1 and 2, includes a housing 11, a driving ram 13 displaceable in a guide 12, and a drive unit for driving the ram 13 and which is generally designated with a reference numeral 30 and is arranged in the housing 11. The guide 12 includes a guide roller 17, pinch means 16 in form of a pinch roller, and a guide channel 18. At an end of the guide 12 facing in a drive-in direction 27, there is provided a magazine 61 with fastening elements 60 which projects sidewise of the guide 12.

At an end of the guide 12 remote from the magazine 61, there is provided a force accumulator 41 that is formed as a compression spring element 42. The force accumulator 41 forms part of an acceleration device generally indicated with a reference numeral 40. The compression spring element 42 is held in a guide cylinder 48 with its first end being fixed relative to the housing 11. The second end of the compression spring element 42 is free and is elastically preloaded against the driving ram 13 in the initial position 22 of the driving ram 13 which is shown in FIG. 1. In the initial position 22, the driving ram 13 is held by a locking device generally indicated with a reference numeral 50. The locking device 50 has a pawl 51 that engages, in a locking position 54, a locking surface 53 in a recess formed in the driving ram 13, retaining the driving ram 13 against a biasing force of the comprising spring element 42. The pawl 51 is supported on an actuator 52 that displaces the pawl 51 into a release position 55, as it would be described further below.

A first control conductor 56 connects the actuator 52 with a control unit 23. The compression spring element 42 is formed, in the embodiment shown in FIG. 1, as a spiral spring.

The drive-in tool 10 further includes a handle 20 on which an actuation switch 19 for initiating a drive-in process with the drive-in tool 10 is arranged. In the handle 20, there is arranged a power source designated generally with a reference numeral 21 and which supplies the drive-in tool 10 with electrical energy. The power source 21 includes, in the embodiment shown in the drawings, at least one accumulator. An electrical conductor 24 connects the power source 21 with the control unit 23. A switch conductor 57 connects the control unit 23 with the actuation switch 19.

At an opening 62 of the drive-in tool 10, switch means 29 is arranged. The switch means 29 is connected by a conductor 28 with the control unit 23. The switch means 29 sends an electrical signal to the control unit 23 as soon as the drive-in tool 10 engages a constructional component U, as shown in FIG. 2, and insures, thus, that the drive-in tool 10 only then actuated when the drive-in tool 10 is properly pressed against the constructional component U.

The drive unit 30 includes an electric motor 31 with a shaft 37. Belt transmission means 33 transmits the rotational movement of the shaft 37 of the motor 31 to a support axle 34 of a drive flywheel 32, rotating the drive flywheel 32 in a direction of arrow 36. The control unit 23 supplies the electrical power to and actuates the motor 31 via a motor conductor 25. The motor 31 can, e.g., already be actuated by the control unit 23 when the drive-in tool 10 is pressed against the constructional component U, and a corresponding signal is communicated by the switch means 29 to the control unit 23. A drive coupling 35, which is formed as a friction coupling, is arranged between the drive flywheel 32 and the driving ram 13. The drive coupling 35 includes a coupling section 15 of the driving ram 13 and which is wider than the driving section 14 of the driving ram 13. Upon movement of the driving ram 13 from its initial position 22 in the drive-in direction 27, the coupling section 15 is brought into the clearance separating the pinch means 16 and the drive flywheel 32, frictionally engaging both the pinch means 16 and the drive flywheel 32. The pinch roller, which forms the pinch means 16, can roll over the driving ram 13 in the direction of arrow 26.

The drive-in tool 10 further includes a return device generally designated with a reference numeral 70. The return device includes a motor 71 and a return roller 72 driven by the motor 71. A second control conductor 74 connects the motor 71 with the control unit 23 which actuates the motor 71 when the driving ram 13 occupies its end, in the drive-in direction 27, position. During its operation, the return roller 72 rotates in a direction of arrow 73 shown with a dash line.

As soon as the drive-in tool 10 is pressed against the constructional component U, as shown in FIG. 2, the switch means 29 generates an actuation signal in response to which the control unit 23 turns on the motor 31 of the drive unit 30 that sets in rotation the drive flywheel 32 in a direction of arrow 36 (see FIG. 2).

Upon actuation of the actuation switch 19 by the user, the control unit 23 displaces the locking device 50 in its release position 55, whereupon the actuator 52 lifts off the pawl 51 out of the recess in the driving ram 13, whereby the pawl 51 becomes disengaged from the locking surface 53 in the driving ram 13.

The compression spring element 42 of the acceleration device 40 accelerates the driving ram 13 in a drive-in direction 27, with the coupling section 15 shooting past the drive flywheel 32. The acceleration device 40 transmits, to the driving ram 13, an energy of minimum about 50 mJ and maximum about 20 J. The pulse, which is transmitted to the driving ram 13 lies in a range from minimum about 50 g*m/s to maximum about 3 kg*m/s. The driving ram 13 is accelerated by the pulse to a speed from about 0.5 m/s to about 20 m/s before the drive flywheel 32 further accelerates the driving ram 13, transmitting additional energy thereto. The energy or the pulse transmitted to the driving ram 13 by the compression spring element 42 depends on the strength of the compression spring element 42 and its preload in the initial position 22 of the driving ram 13.

With the acceleration of the driving ram 13 according to the present invention, the slippage between the flywheel 32 and the coupling section 15 of the driving ram 13, upon actuation of the drive coupling 35, can be noticeably reduced. This makes possible rotation of the drive flywheel 32 with higher rotational speeds and, thereby, transmission of a greater kinetic energy by the drive flywheel 32 to the driving ram 13.

For returning the driving ram 13 into its initial position, as it has already been described, at the end of a drive-in process the control unit 23 actuates the return device 70. The return device 70 displaces the driving ram 13 against the compression spring element 42 of the acceleration device 40, again preloading the compression spring element 42. The return device 70 displaces the driving ram 13 until the pawl 51 again falls into the recess in the driving ram 13 and engages the locking surface 54, returning to its locking position. The pawl 51 is biased in the direction of the driving ram 13.

Figure 3:
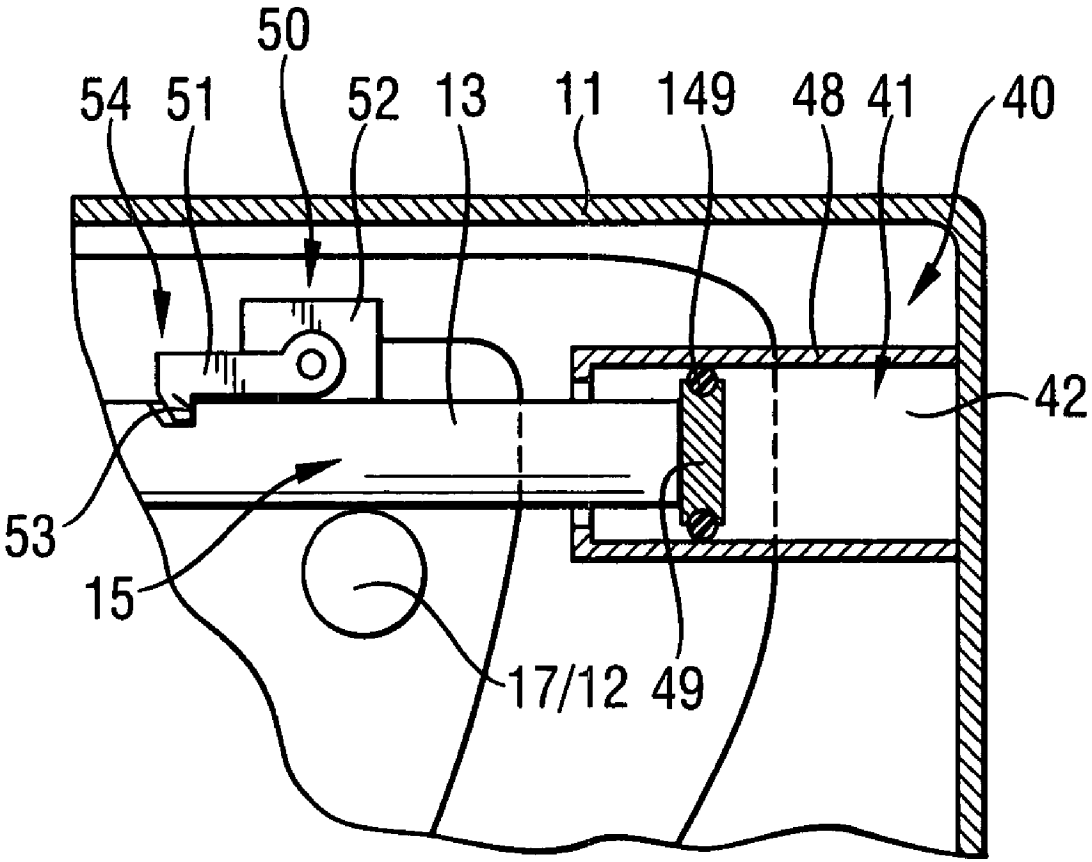
FIG. 3 a cross-sectional cutout view of another embodiment of a drive-in tool according to the present invention.

A drive-in tool, a portion of which is shown in FIG. 3, differs from the drive-in tool, 10 shown in FIGS. 1-2 in that the compression spring element 42 is formed as a gas spring. To this end, the end of the driving ram 13, which is located in the guide cylinder 48, is provided with piston head 49 equipped with sealing ring 149. Otherwise, the drive-in tool of FIG. 3 functions in the same manner as the drive-in tool of FIGS. 1-2, and for the details of operation of the drive-in tool of FIG. 3, reference is made to the related description with reference to FIGS. 1-2.

Figure 4:
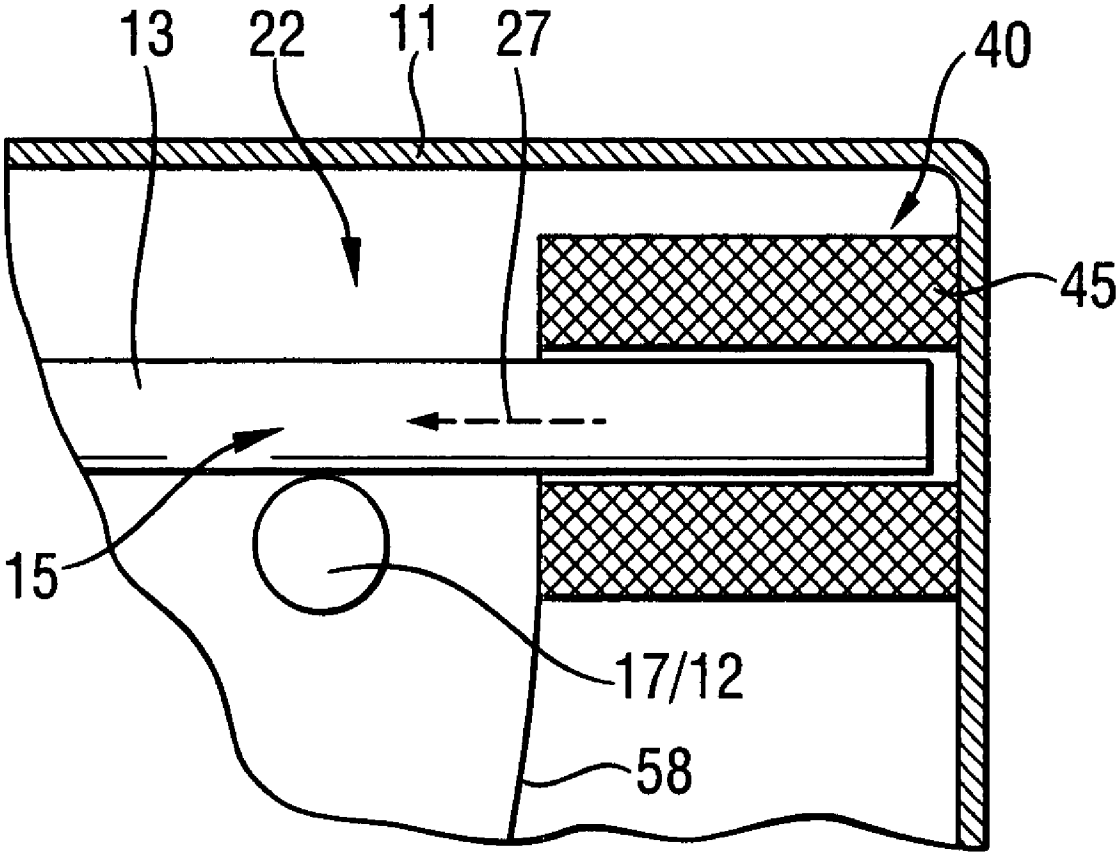
FIG. 4 a cross-sectional cutout view of yet another embodiment of a drive-in tool according to the present invention.

A drive-in tool, a portion of which is shown in FIG. 4, differs from the drive-in tool 10 shown in FIGS. 1-2, in that the acceleration device 40 has, instead of the force accumulator, a magnetic coil element 45 connected with the control unit 23 by a control conductor 58. The driving ram 13 is formed, at least at its end adjacent to the magnetic coil element 45, as an iron or coil core. A separate locking device, such as the locking device 50 in the tool of FIGS. 1-2, is not provided, because its function is taken over by the magnetic coil element 45. In the initial position 22 of the driving ram 13, it is held in the coil element 45 by an appropriate polarity that is controlled by the control unit 23. When the drive-in tool is pressed against a constructional component, as shown in FIG. 2, in response to the actuation signal generated by actuation switch 19 the control unit 23 reverses the polarity of the magnetic coil element 45. Thereby, the driving ram 13 is pushed out of the magnetic coil element 45 and is accelerated in the drive-in direction 27, with the coupling section 15 shooting past the drive flywheel 32. For other details not described here, reference is made to the description of the drive-in tool shown in FIG. 1-2.

Figure 5:
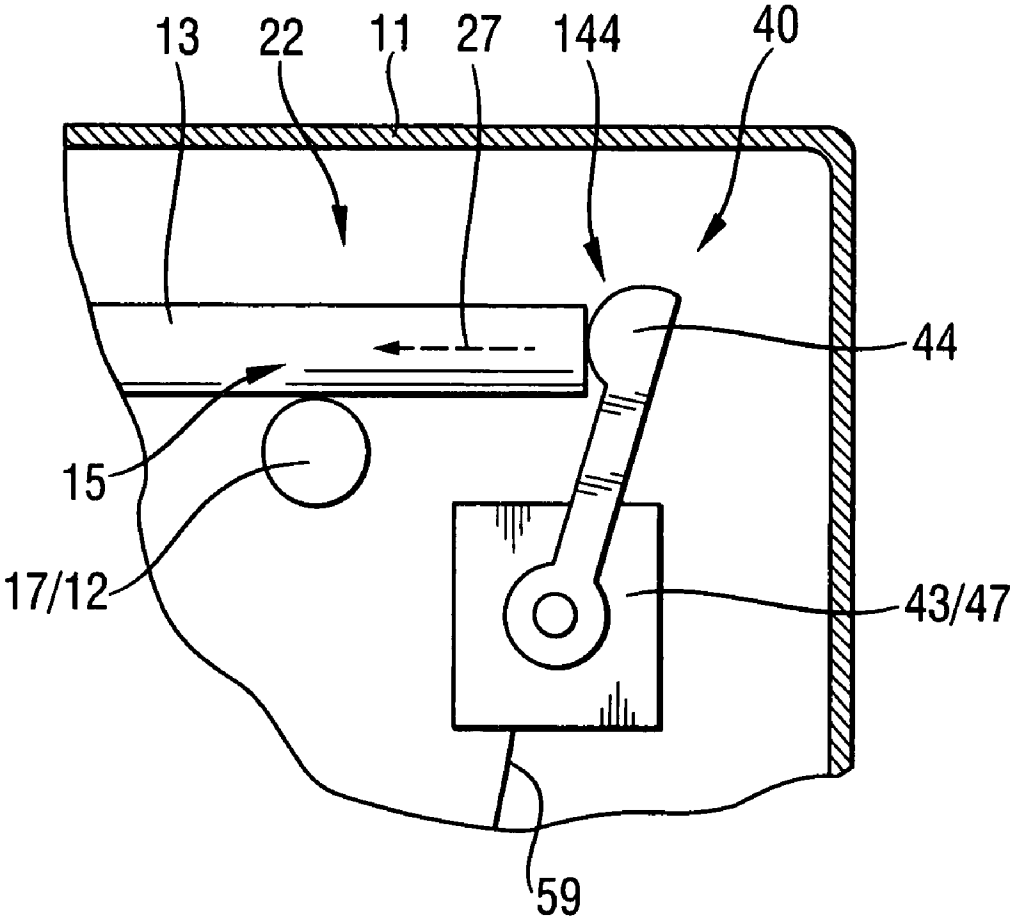
FIG. 5 a cross-sectional cutout view of a further embodiment of a drive-in tool according to the present invention.

A drive-in tool shown in FIG. 5 differs from the drive-in tool 10 shown in FIGS. 1-2 in that the acceleration device 40 instead of the force accumulator, includes a motorized acceleration means 43 with driven means 44. A control conductor 59 connects the electric motor 47 that forms the acceleration means 43 with, the control unit 23. Preferably, the electric motor 47 has a smaller power than the electric motor 31 that drives the flywheel 32. In the initial position 22 of the driving ram 13, the driving ram 13 engages, with its end facing in the direction opposite the drive-in direction 27, an end of the driven means 44 that is formed as a driver element 144. When the drive-in tool is pressed against a constructional component, as shown in FIG. 2, the control unit 23 feeds, in response to the actuation signal of the actuation switch 19, current to the electric motor 47, actuating it. Upon actuation of the electric motor 47, the driven means 44 moves in catapult-like manner against the rear end of the driving ram 13 As a result, the driving ram 13 is accelerated in the drive-in direction 27, shooting with its coupling section 16 past the drive flywheel 32. For other non-described detail of the drive-in tool, reference is made to the previous description with reference to FIGS. 1-2.

Figure 6:
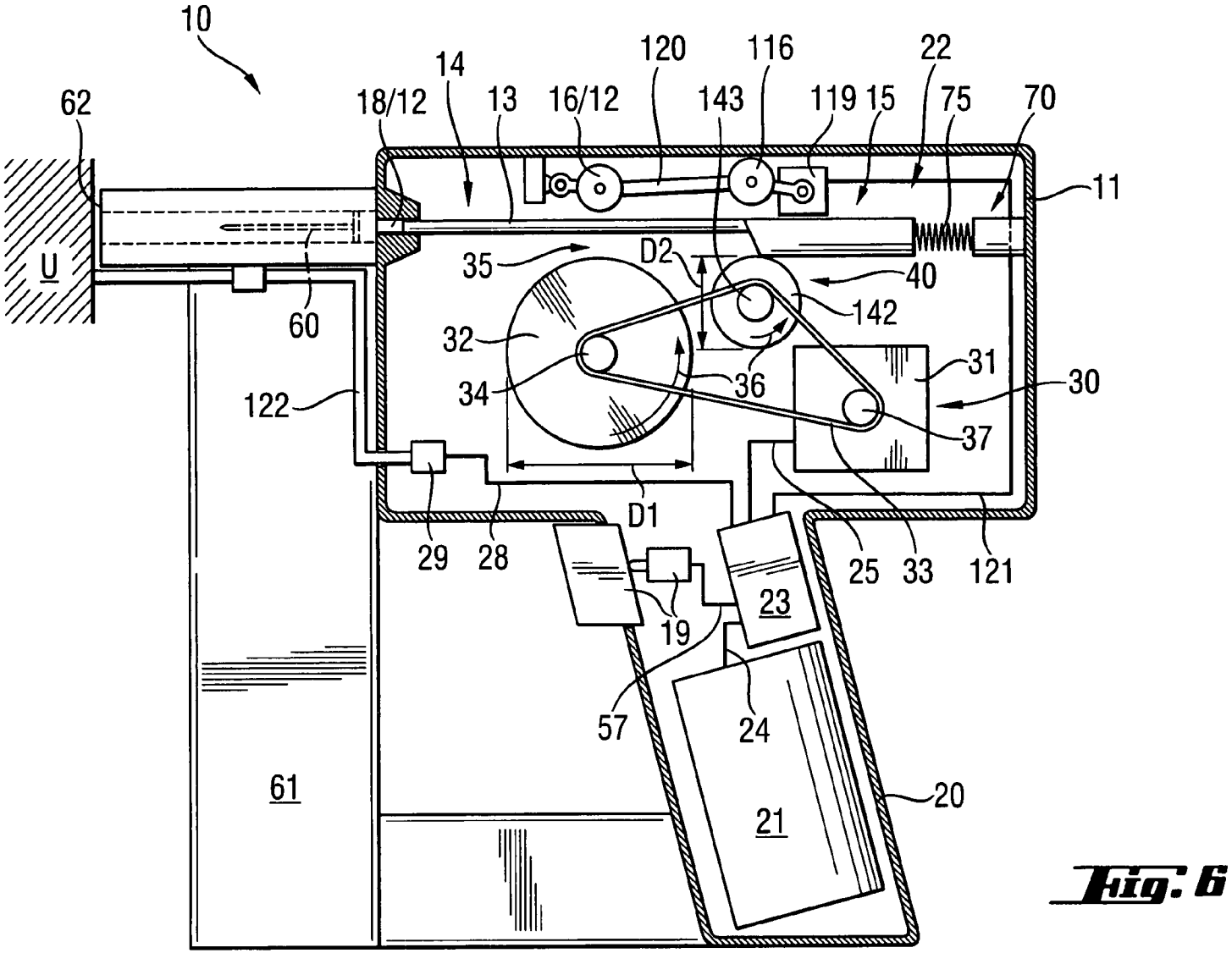
FIG. 6 a longitudinal cross-sectional view of a still further embodiment of a drive-in tool according to the present invention in an initial position thereof.
Figure 1:
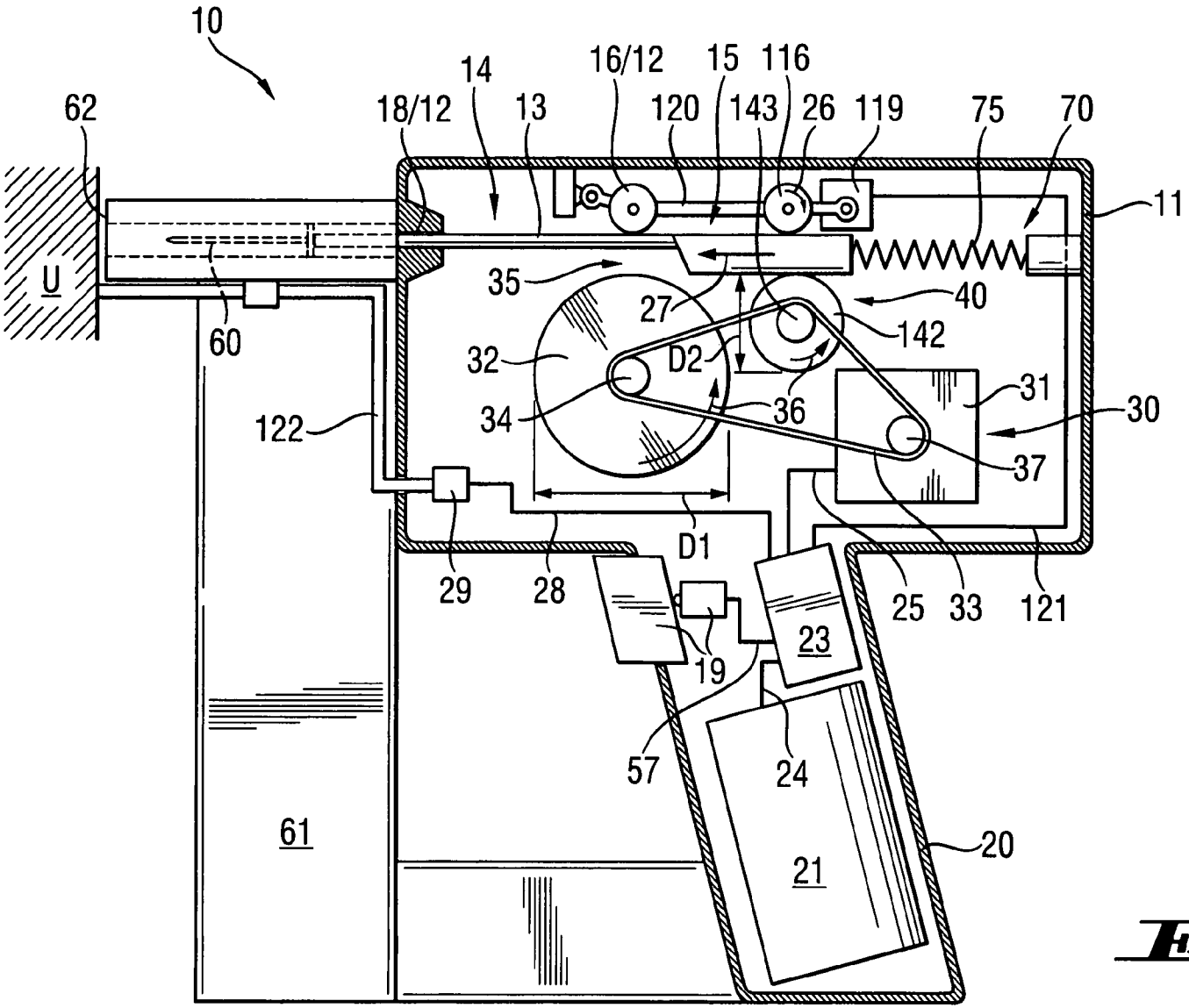
Figure 8:
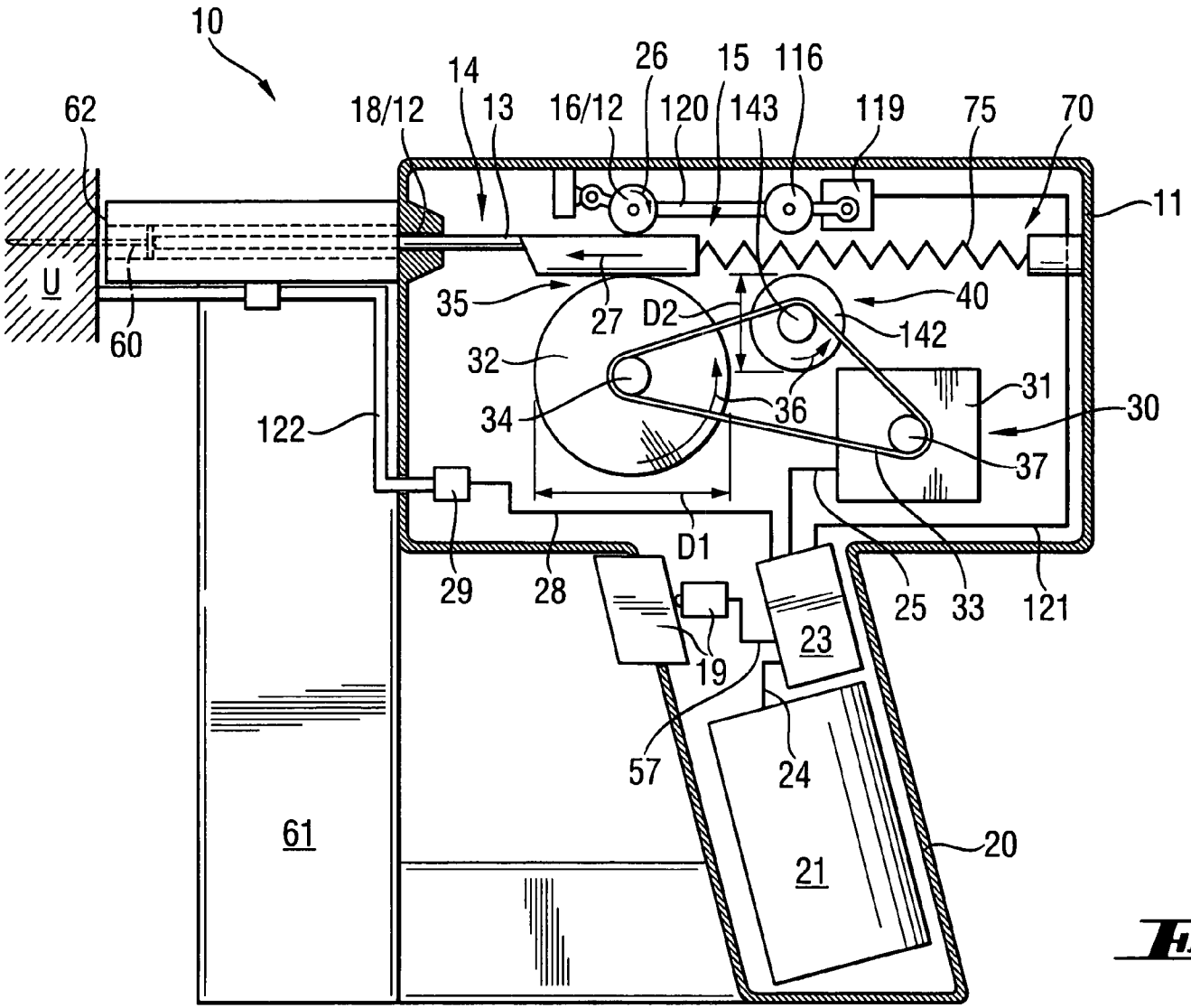
FIG. 8 a longitudinal cross-sectional view of the drive-in tool shown in FIG. 6 in a second operational position thereof.

A drive-in tool 10 according to the present invention, which is shown in FIGS. 6-8 also includes a housing 11, a driving ram 13 displaceable in a guide 12, and a drive unit for driving the ram 13 and which is generally designated with a reference numeral 30 and is arranged in the housing 11. The guide 12 includes first pinch means 16 and second pitch means 116 each in form of a pinch roller, and a guide channel 18. At an end of the guide 12 facing in a drive-in direction 27, there is provided a magazine 61 with fastening elements 60 which projects sidewise of the guide 12.

The first and second pinch means 16 and 116 are rotatably supported on a multi-link support arm 120 displaceable in a direction toward the driving ram 13 by an actuator 119. A control conductor 121 connects the actuator 119 with the control unit 23. The activated pinch means 16, 116 can roll respectively, over the driving ram 13 in the direction of arrow 26.

The drive-in tool 10 further includes a handle 20 on which an actuation switch 19 for initiating a drive-in process with the drive-in tool 10 is arranged. In the handle 20, there is arranged a power source designated generally with a reference numeral 21 and which supplies the drive-in tool 10 with electrical energy. The power source 21 includes, in the embodiment shown in the drawings, at least one accumulator. An electrical conductor 24 connects the power source 21 with the control unit 23. A switch conductor 57 connects the control unit 23 with the actuation switch 19.

At an opening 62 of the drive-in tool 10, a feeler 122 is arranged. The feeler 122 actuates switch means 29 which is connected by a conductor 28 with the control unit 23. The switch means 29 sends an electrical signal to the control unit 23 as soon as the drive-in tool 10 engages a constructional component U, as shown in FIGS. 6-8 and insures, thus, that the drive-in tool 10 only then actuated when the drive-in tool 10 is properly pressed against the constructional component U.

The drive unit 30 includes an electric motor 31 with a shaft 37. Belt transmission means 33 transmits the rotational movement of the shaft 37 of the motor 31 to a support axle 34 of a drive flywheel 32, rotating the drive flywheel 32 in a direction of arrow 36. The drive wheel has an outer diameter D1. The control unit 23 supplies the electrical power to and actuates the motor 31 via a motor conductor 25. The motor 31 can, e.g., already be actuated by the control unit 23 when the drive-in tool 10 is pressed against the constructional component U, and a corresponding signal is communicated by the switch means 29 to the control unit 23. A drive coupling 35, which is formed as a friction coupling, is arranged between the drive flywheel 32 and the driving ram 13. The drive coupling 35 includes a coupling section 15 of the driving ram 13 and which is wider than the driving section 14 of the driving ram 13. Upon movement of the driving ram 13 from its initial position 22 in the drive-in direction 27, and lowering of the pinch means 16 by the adjusting means 119, the coupling section 15 is brought into the clearance separating the pinch means 16 and the drive flywheel 32, frictionally engaging both the pinch means 16 and the drive flywheel 32.

At the end of the guide 12 remote from magazine 61, there is provided an acceleration flywheel 142 which forms part of an acceleration device generally designated with a reference numeral 140. The acceleration flywheel 142 is supported on a support axle 143 driven by the motor 31 via the transmission 33. The acceleration flywheel 142 has an outer diameter D2 which is smaller than the diameter D1 of the drive flywheel 32. Therefore, the maximal circumferential speed of the acceleration flywheel 142 is smaller than the maximal circumferential speed of the drive flywheel 32.

The drive-in tool 10 further includes a return device generally designated with a reference numeral 70. The return device 70 includes a spring 75 formed as a tension spring. The spring 75 displaces the driving ram 13 in its initial position 22 when the driving ram 13 occupies is end, in the drive-in direction 27, position.

Upon the drive-in tool 10 being pressed against a constructional component, as shown in FIG. 6, the switch means 29 generates an actuation signal. In response to the actuation signal, the control unit 23 turns on the motor 31 of the drive unit 30. As a result, the drive flywheel 32 and the acceleration flywheel 142 are rotated in the rotational direction of arrow 36 (see FIGS. 6-8).

Upon actuation of the actuation switch 19 by the tool user, the control unit 23 actuates the actuator 119 that displaces the support arm 120, together with pinch means 16 and 116 in direction toward the drive-in ram 13. With the pinch means 116 applying pressure to the driving ram 13 in the direction of the acceleration flywheel 142, the driving ram 13 together with the coupling section 15, becomes connected with the rotatable acceleration flywheel 142 that accelerates the driving ram 13 in the drive-in direction 27, shooting the coupling section 15 past the drive flywheel 32. The slippage of the second, acceleration flywheel 142 is relatively small because of its smaller circumferential speed. The acceleration device 40 transmits to the driving ram 13 an energy of minimum about 50 mJ and maximum about 20 J. The pulse, which is transmitted to the driving ram 13 lies in a range from minimum about 50 g*m/s to maximum about 3 kg*m/s. The driving ram 13 is accelerated by the pulse to a speed from about 0.5 m/s to about 20 m/s before the drive flywheel 32 further accelerates the driving ram 13, transmitting additional energy thereto. The energy or the pulse transmitted to the driving ram 13 by the acceleration flywheel 142 depends on the circumferential speed of the acceleration flywheel 142.

With the acceleration of the driving ram 13 according to the present invention, the slippage between the flywheel 32 and the coupling section 15 of the driving ram 13, upon actuation of the drive coupling 35, can be noticeably reduced. This makes possible rotation of the drive flywheel 32 with higher rotational speeds and, thereby, transmission of a greater kinetic energy by the drive flywheel 32 to the driving ram 13.

Returning of the driving ram 13 into its initial position, as it has already been described, at the end of a drive-in process is effected by the return device 70 the spring element 72 of which pulls the driving ram 13 back to its initial position 22. The pinch means 16 and 116, which are supported on the support arm 120, are lifted off the driving ram 13 by the actuator 119 before the return movement of the driving ram.

Figure 9:
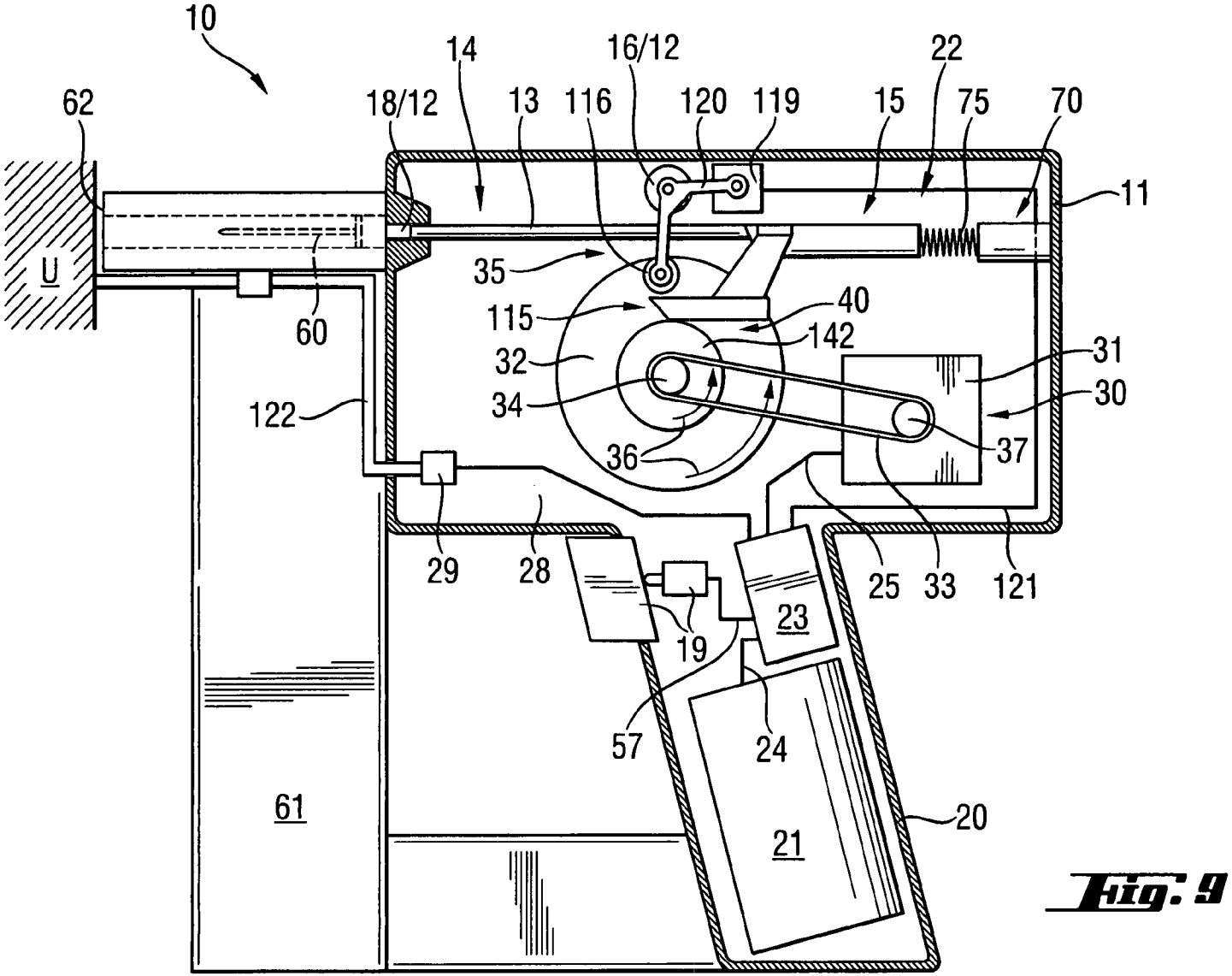
FIG. 9 a longitudinal cross-sectional view of a yet further embodiment of a drive-in tool according to the present invention in an initial position thereof.
Figure 10:
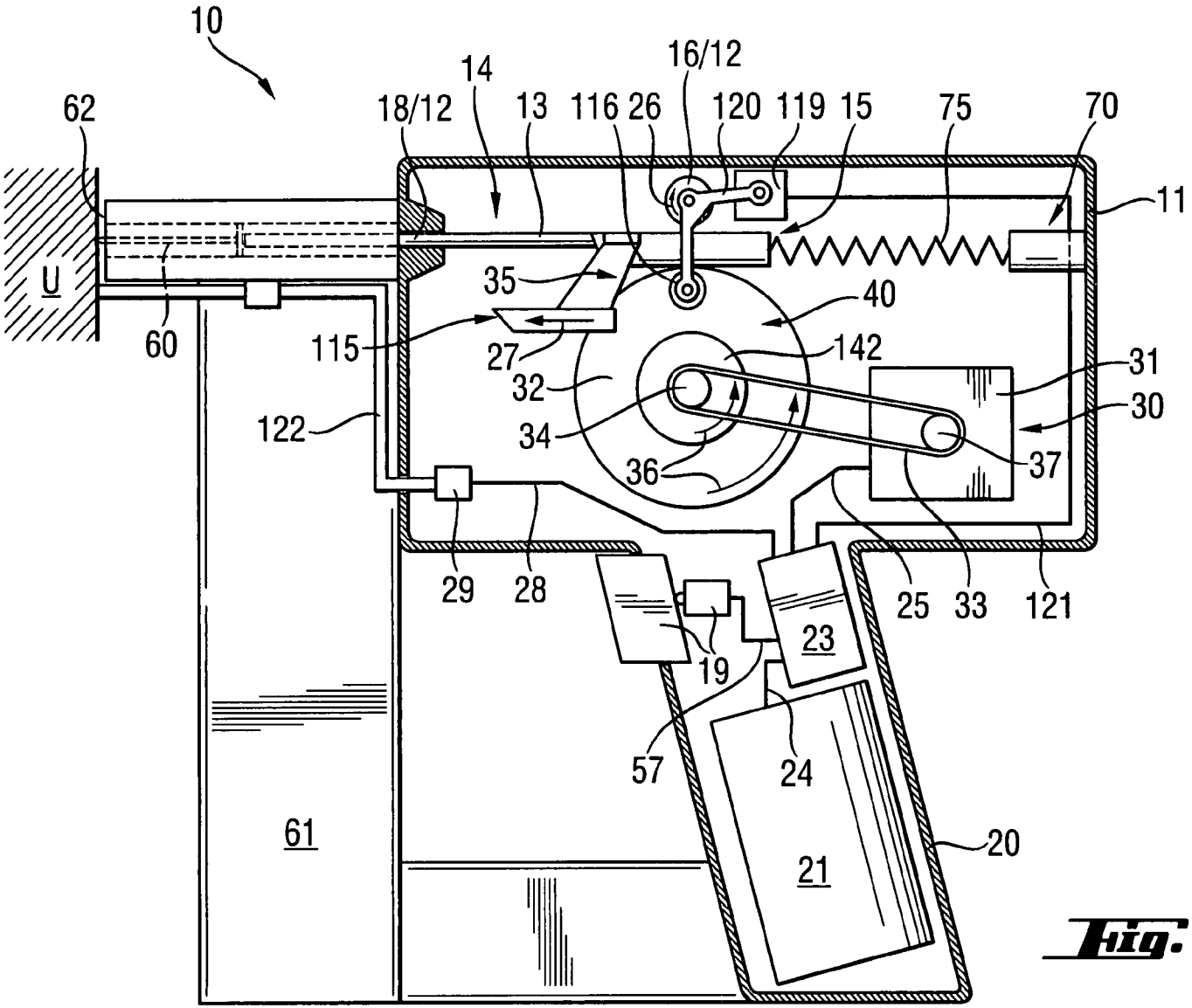
FIG. 10 a longitudinal cross-sectional view of the drive-in tool shown in FIG. 9 in an operational position thereof.

A drive-in tool 10, which is shown in FIGS. 9-10, differs from the drive-in tool 10 shown in FIGS. 6-8 in that the acceleration flywheel 142 of the acceleration device 40 is supported coaxially with the drive flywheel 32 on the same support axle 34. The driving ram 13 has a second coupling section 115 which connects the driving ram 13 with the second, acceleration flywheel 142 when the pinch means 16 and the pinch means 116, which are supported on a support arm 120, are displaced by the actuator 119 in the direction toward the drive ram 13. The length of the second, coupling section 115 is so selected that it is connected with the acceleration flywheel 142 only for a short time necessary for transmission of the acceleration to the drive ram 13. As can be seen in FIG. 10, the driving ram 13, after having been accelerated by the acceleration flywheel 142, is driving by the drive flywheel 32 for driving a fastening element 60 in a constructional component U. For other details of the drive-in tool shown in FIGS. 9-10, which are not described here, reference is made to the description with reference to FIGS. 6-8.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. An electrical drive-in tool for driving in fastening elements, comprising:

a guide (12);

a driving ram (13) displaceable in the guide (12) for driving in a fastening element;

at least one drive flywheel (32) for driving the driving ram (13);

a drive unit (30) for driving the at least one drive flywheel (32) and including an electric motor (31) for rotating the at least one drive flywheel (32);

a drive coupling (35) for connecting a coupling section (15) of the driving ram (13) with the at least one drive flywheel (32); and an acceleration device (40), including an acceleration flywheel (142) having a maximal circumferential speed which is smaller than a maximal circumferential speed of the drive flywheel (32), for transmitting an energy from about 50 mJ to about 20 J to the driving ram for accelerating the driving ram (13), together with the coupling section (15) thereof, in a direction of the drive flywheel (32).

2. A drive-in tool according to claim 1, wherein the acceleration device (40) transmits to the driving ram (13) a pulse from 50 g*m/s to 3 kg*m/s.

3. A drive-in tool according to claim 1, wherein the acceleration flywheel (142) is supported on a separate support axle (143).

4. A drive-in tool according to claim 1, wherein the acceleration flywheel (142) is supported on a same support axle (34) as the drive flywheel (32).

5. A drive-in tool according to claim 1, wherein the acceleration flywheel (142) has a smaller outer diameter (D2) than an outer diameter (D1) of the drive flywheel (32).

6. A drive-in tool according to claim 1, wherein the drive unit (30) drives both the at least one drive flywheel (32) and the acceleration flywheel (142).

7. An electrical drive-in tool for driving in fastening elements, comprising:

a guide (12);

a driving ram (13) displaceable in the guide (12) for driving in a fastening element;

at least one drive flywheel (32) for driving the driving ram (13) in a drive-in direction;

a drive unit (30) for driving the at least one drive flywheel (32) and including an electric motor (31) for rotating the at least one drive flywheel (32);

a drive coupling (35) for connecting a coupling section (15) of the driving ram (13) with the at least one drive flywheel (32); and an acceleration device (40), including an acceleration flywheel (142) having a maximal circumferential speed which is smaller than a maximal circumferential speed of the drive flywheel (32), for transmitting an energy from about 50 mJ to about 20 J to the driving ram for accelerating the driving ram (13), together with the coupling section (15) thereof, in the drive-in direction.

8. A drive-in tool according to claim 7, wherein the drive-in direction is in the direction of the drive flywheel (32).

9. A drive-in tool according to claim 7, wherein the acceleration flywheel (142) is supported on a separate support axle (143).

10. A drive-in tool according to claim 7, wherein the acceleration flywheel (142) is supported on a same support axle (34) as the drive flywheel (32).

11. A drive-in tool according to claim 7, wherein the acceleration flywheel (142) has a smaller outer diameter (D2) than an outer diameter (D1) of the drive flywheel (32).

* * * * *